US008382948B2

(12) United States Patent
Haehnle et al.

(10) Patent No.: US 8,382,948 B2
(45) **Date of Patent: *Feb. 26, 2013**

(54) PRODUCTION OF PAPER

(75) Inventors: Hans-Joachim Haehnle, Neustadt (DE); Anton Esser, Limburgerhof (DE)

(73) Assignee: BASF SE, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/996,688

(22) PCT Filed: Jun. 9, 2009

(86) PCT No.: PCT/EP2009/057104
§ 371 (c)(1),
(2), (4) Date: Dec. 7, 2010

(87) PCT Pub. No.: WO2009/156274

PCT Pub. Date: Dec. 30, 2009

(65) Prior Publication Data

US 2011/0079365 A1 Apr. 7, 2011

(30) Foreign Application Priority Data

Jun. 24, 2008 (EP) ..... 08158838

(51) Int. Cl.
*D21H 11/00* (2006.01)

(52) U.S. Cl. ..... 162/164.5

(58) Field of Classification Search ..... 162/164.5
See application file for complete search history.

(56) References Cited

U.S. PATENT DOCUMENTS

| | | | |
|---|---|---|---|
| 5,008,321 | A | 4/1991 | Hartmann et al. |
| 5,389,203 | A | 2/1995 | Sawayama et al. |
| 5,630,907 | A | 5/1997 | Nilz et al. |
| 6,024,836 | A | 2/2000 | Sollinger et al. |
| 6,060,566 | A | 5/2000 | Denzinger et al. |
| 2004/0149411 | A1 | 8/2004 | Kruger et al. |
| 2005/0197278 | A1 | 9/2005 | Esser et al. |
| 2006/0024262 | A1 | 2/2006 | Hahnle et al. |
| 2006/0037725 | A1 | 2/2006 | Hahnle et al. |
| 2006/0037727 | A1 | 2/2006 | Hagiopol et al. |
| 2008/0099172 | A1 | 5/2008 | Pelton et al. |
| 2009/0008051 | A1 | 1/2009 | Kruger et al. |
| 2009/0165978 | A1 | 7/2009 | Hagiopol et al. |
| 2010/0179248 | A1 | 7/2010 | Esser et al. |
| 2010/0181037 | A1 | 7/2010 | Esser et al. |
| 2010/0181038 | A1 | 7/2010 | Esser et al. |
| 2010/0186915 | A1 | 7/2010 | Esser et al. |
| 2011/0079365 | A1 | 4/2011 | Haehnle et al. |
| 2011/0230601 | A1 | 9/2011 | Nieberle et al. |

FOREIGN PATENT DOCUMENTS

| | | |
|---|---|---|
| DE | 42 41 117 | 6/1994 |
| DE | 195 26 626 | 1/1997 |
| DE | 43 28 975 | 9/2006 |
| EP | 0 251 182 | 1/1988 |
| EP | 0 374 646 | 6/1990 |
| EP | 0 528 409 | 2/1993 |
| EP | 0 672 212 | 9/1995 |
| EP | 0 780 513 | 6/1997 |
| EP | 07 111 617.2 | 7/2007 |
| EP | 07 111 859.0 | 7/2007 |
| JP | 08 059740 | 3/1996 |
| WO | 94 13882 | 6/1994 |
| WO | 02 101144 | 12/2002 |
| WO | 2004 087818 | 10/2004 |
| WO | 2005 012637 | 2/2005 |
| WO | 2005 059251 | 6/2005 |
| WO | 2005 089175 | 9/2005 |
| WO | 2006 010268 | 2/2006 |
| WO | 2006 066769 | 6/2006 |
| WO | 2009 004018 | 1/2009 |
| WO | WO 2009/004078 A1 | 1/2009 |

OTHER PUBLICATIONS

Schwarz, M., et al., "Initiale Gefuegefestigkeit bei der Blattbildung," Wochenblatt Fuer Papierfabrikation, vol. 131, No. 16, pp. 950-957, (Aug. 2003).
International Search Report issued Nov. 25, 2009 in PCT/EP09/057104 filed Jun. 9, 2009.
U.S. Appl. No. 12/990,763, filed Nov. 2, 2010, Esser, et al.
U.S. Appl. No. 13/058,217, filed Feb. 9, 2011, Haehnle, et al.
U.S. Appl. No. 13/147,623, filed Aug. 3, 2011, Esser, et al.
U.S. Appl. No. 13/376,509, Dec. 6, 2011, Jehn-Rendu, et al.
U.S. Appl. No. 13/502,885, filed Apr. 19, 2012, Esser.

*Primary Examiner* — Mark Halpern
(74) *Attorney, Agent, or Firm* — Oblon, Spivak, McClelland, Maier & Neustadt, L.L.P.

(57) ABSTRACT

The use of water-soluble, amphoteric copolymers which are obtainable by copolymerization of a) at least one N-vinylcarboxamide of the general formula (I)

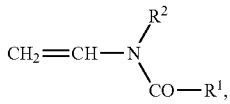

in which $R^1$ and $R^2$, independently of one another, are H or $C_1$- to $C_6$-alkyl, b) at least one monomer which is selected from the group consisting of (b1) monoethylenically unsaturated sulfonic acids, phosphonic acids, phosphoric acid esters and derivatives thereof, and (b2) monoethylenically unsaturated mono- and dicarboxylic acids, the salts thereof and dicarboxylic anhydrides, c) if appropriate, at least one monoethylenically unsaturated monomer differing from the components (a) and (b), and d) if appropriate, at least one compound which has at least two ethylenically unsaturated double bonds in the molecule, with the proviso that the monomer mixture comprises at least one monomer (b) having at least one free acid group and/or an acid group in salt form, and subsequent partial or complete hydrolysis of the groups —CO—$R^1$ from the monomers (a) incorporated in the form of copolymerized units into the copolymer, as agents for increasing the initial wet web strength of paper.

15 Claims, No Drawings

PRODUCTION OF PAPER

This application is a 371 of PCT/EP09/57104 filed 9 Jun. 2009 .

The invention relates to the use of amphoteric copolymers comprising amidine groups as agents for increasing the initial wet web strength of paper.

Initial wet web strength is understood as meaning the strength of a wet paper which was never dried. It is the strength of a wet paper as present in papermaking after passing through the wire and press section of the paper machines. It typically comprises about 50% of water.

A distinction should be made between the initial wet web strength and the wet strength and the initial wet strength of paper, because the two properties are measured on papers which are moistened to a defined water content after drying. The initial wet strength is an important parameter in the assessment of papers which do not have permanent wet strength. A paper which has been dried and then moistened again has a very different wet strength compared with a moist paper which is present directly after passing through the wire and press section of a paper machine. A detailed description of the initial wet web strength and its importance in papermaking is given by M. Schwarz and K. Bechtel in the article "Initiale Gefügefestigkeit bei der Blattbildung" in Wochenblatt für Papierfabrikation 131, pages 950-957 (2003) No. 16.

A decisively limiting factor on the route to further increase the speed of paper machines is the initial wet web strength. It limits the maximum applicable force which can be exerted on a sheet which has just formed in the paper machine, has passed the wire section and the press section of the machine and has been transferred to the dry end. Here, the sheet must be taken off from the press rolls. In order to be able to ensure tear-free operation of a paper machine, the applied take-off force at this point must be substantially smaller than the initial wet web strength of the moist paper. An increase in the initial wet web strength permits the application of higher take-off forces and hence fast operation of the paper machine, cf. EP-B-0 780 513.

It is true that it is known that the initial wet web strength can be increased by increasing the solids content of the paper at the point between press section and dry end in the production process. In between, however, substantially all mechanical engineering possibilities for achieving a further increase in the initial wet web strength have been exhausted. Even the possibility of improving the solids content at this point of the process by additives for increasing the drainage is subject to limits because at the same time good formation of the resulting sheet must be ensured.

No process has been described to date by means of which the initial wet web strength of paper can be directly influenced by addition of an additive without increasing the solids content.

WO-A-04/087818, WO-A-05/012637 and WO-A-2006066769 describe aqueous slurries of finely divided fillers which are at least partly coated with polymers and which are obtainable by treating aqueous slurries of finely divided fillers with at least one water-soluble amphoteric copolymer which comprises amidines having a 6-membered ring. These slurries permit an increase in the filler content in papers while retaining the paper properties, in particular the dry strength.

The prior applications EP 07 111 859.0 and EP 07 111 617.2 moreover disclose that the filler content of paper can be increased by pretreating fillers with the abovementioned polymers before use in the papermaking process, the pretreatment additionally being carried out in the presence of swollen starch or additionally in the presence of latices.

JP-A 08059740 discloses that amphoteric water-soluble polymers are added to aqueous suspensions of inorganic particles, at least a part of the polymers being adsorbed on the filler surface. The amphoteric polymers are preferably prepared by hydrolysis of copolymers of N-vinylformamide, acrylonitrile and acrylic acid in the presence of acids. They comprise from 20 to 90 mol % of amidine units having a 5-membered ring and of the structure

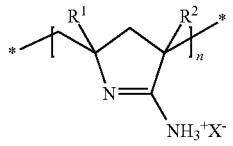

in which $R^1$ and $R^2$ are in each case H or a methyl group, n is an integer and $X^-$ is an anion. The filler slurries treated with such polymers are added to the paper stock in the production of filler-containing papers. The filler treatment leads to an improvement in the drainage of the paper stock and moreover results in an improvement in various strength properties of the dried paper and an improvement in the filler retention.

Furthermore, EP-A-0528409 and DE-A-4328975 describe weakly amphoteric polymers which comprise amidines having a 5-membered ring. They are used as flocculants in the first case while they are employed as papermaking additives in the second case. However, in both applications reference is made to the fact that the proportion of the anionic structural units is detrimental to the efficiency and should therefore typically be less than 5 mol %, cf. EP-A-0528409, page 5, line 41 et seq. and DE-A-4328975, page 6, paragraph 0027.

None of said publications mention influencing the initial wet web strength by using amphoteric polymers comprising amidine units in the papermaking.

It is the object of the invention to increase the initial wet web strength of the still moist paper web prior to transfer to the dry end in the production of paper, in order to achieve a higher machine speed compared with known processes in the papermaking process.

The object is achieved, according to the invention, by the use of water-soluble, amphoteric copolymers which are obtainable by copolymerization of a) at least one N-vinylcarboxamide of the general formula

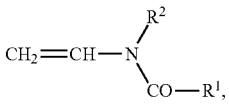

(I)

in which $R^1$ and $R^2$, independently of one another, are H or $C_1$- to $C_6$-alkyl, b) at least one monomer which is selected from the group consisting of (b1) monoethylenically unsaturated sulfonic acids, phosphonic acids, phosphoric acid esters and derivatives thereof, and (b2) monoethylenically unsaturated mono- and dicarboxylic acids, the salts thereof and dicarboxylic anhydrides, c) if appropriate, at least one monoethylenically unsaturated monomer differing from the components (a) and (b), and d) if appropriate, at least one compound which has at least two ethylenically unsaturated double bonds in the molecule, with the proviso that the monomer mixture comprises at least one monomer (b) having at least one free acid group and/or an acid group in salt form, and subsequent partial or complete hydrolysis of the groups —CO—$R^1$ from the monomers (a) incorporated in the form of polymerized units into the copolymer, as agents for increasing the initial wet web strength of paper.

The treatment of the fibers is effected, for example, in the high-consistency stock and/or in the low-consistency stock in the papermaking process, pretreatment of the fibers in the low-consistency stock being preferred. A high-consistency stock has, for example, a fiber concentration of >15 g/l, for example in the range from 25 to 40 g/l up to 60 g/l, while a low-consistency stock has, for example, a fiber concentration of <15 g/l, for example in the range from 5 to 12 g/l.

The hydrolyzed copolymers comprise the following structural units:

amidines (II)

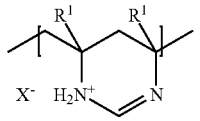

(III)

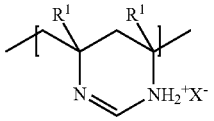

(IV)

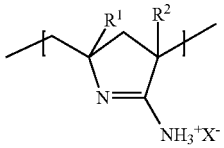

(V)

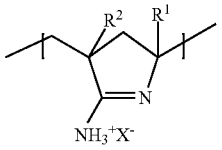

amino groups (VI)

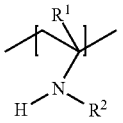

the substituents $R^1$ and $R^2$ in the formulae II-VI having the meaning stated in formula I and $X^-$in the formulae II to V being an anion, and units of ethylenically unsaturated acids of group (b) in the form of the free acids and/or in salt form.

In the hydrolyzed copolymers, for example, the ratio A of amidine units to amine units is from 100:1 to 1:30, preferably from 40:1 to 1:15, particularly preferably from 8:1 to 1:8. The ratio B of cationic to anionic units is, for example, in the range from 20:1 to 1:20, preferably from 12:1 to 1:12, particularly preferably from 7:1 to 1:7. In this context, cationic units is to be understood as meaning the sum of amine and amidine units, while the acids units which form from the monomers of group (b) in the copolymerization and which are present in the form of the free acid groups and/or in salt form are subsumed under anionic units.

The unhydrolyzed copolymers comprise in each case at least one monomer of groups (a) and (b) and, if appropriate, at least one monomer of group (c) and, if appropriate, at least one monomer of group (d) incorporated in the form of polymerized units.

Examples of monomers of group (a) are open-chain N-vinylamide compounds of the formula (I), such as, for example, N-vinylformamide, N-vinyl-N-methylformamide, N-vinylacetamide, N-vinyl-N-methylacetamide, N-vinyl-N-ethylacetamide, N-vinylpropionamide and N-vinyl-N-methylpropionamide and N-vinylbutyramide. The monomers of group (a) can be used alone or as a mixture in the copolymerization with the monomers of the other groups. From this group, N-vinylformamide is preferably used in the copolymerization.

The copolymers to be used according to the invention comprise at least one monomer of group (b), these monomers being selected from the group consisting of (b1) monoethylenically unsaturated sulfonic acids, phosphonic acids, phosphoric acid esters and derivatives thereof, and (b2) monoethylenically unsaturated mono- and dicarboxylic acids, the salts thereof and dicarboxylic anhydrides.

Suitable monomers of group (b1) are compounds which have an organic radical having a polymerizable, α,β-ethylenically unsaturated double bond and at least one sulfo or phosphonic acid group per molecule. The salts and esters of the abovementioned compounds are furthermore suitable. The esters of the phosphonic acids may be the monoesters or the diesters. Suitable monomers (b1) are furthermore esters of phosphoric acid with alcohols having a polymerizable, α,β-ethylenically unsaturated double bond. One or both of the other protons of the phosphoric acid group can be neutralized by suitable bases or can be esterified with alcohols which have no polymerizable double bonds.

Suitable bases for the partial or complete neutralization of the acid groups of the monomers (b1) are, for example, alkali metal or alkaline earth metal bases, ammonia, amines and/or alkanolamines. Examples of these are sodium hydroxide, potassium hydroxide, sodium carbonate, potassium carbonate, sodium bicarbonate, potassium bicarbonate, magnesium hydroxide, magnesium oxide, calcium hydroxide, calcium oxide, triethanolamine, ethanolamine, morpholine, diethylenetriamine or tetraethylenepentamine. Suitable alcohols for the esterification of phosphoric acid are, for example, $C_1$-$C_6$-alkanols, such as, for example, methanol, ethanol, n-propanol, isopropanol, n-butanol, sec-butanol, tert-butanol, n-pentanol, n-hexanol and the isomers thereof.

The monomers (b1) include, for example, vinylsulfonic acid, allylsulfonic acid, methallylsulfonic acid, sulfoethyl acrylate, sulfoethyl methacrylate, sulfopropyl acrylate, sulfopropyl methacrylate, 2-hydroxy-3-acryloyloxypropylsulfonic acid, 2-hydroxy-3-methacryloyloxypropylsulfonic acid, styrenesulfonic acid, acrylamidomethylene-phosphonic acid, 2-acrylamido-2-methylpropanesulfonic acid, vinylphosphonic acid, $CH_2$=CH—NH—$CH_2$—$PO_3H$, monomethyl vinylphosphonate, dimethyl vinylphosphonate, allylphosphonic acid, monomethyl allylphosphonate, dimethyl allylphosphonate, acrylamidomethylpropylphosphonic acid, (meth)acryloylethylene glycol phosphate and monoallyl phosphate.

If exclusively monomers in which all protons of the acid groups are esterified, such as, for example, dimethyl vinylphosphonate or dimethyl allylphosphonate, are used as component (b1), at least one monoethylenically unsaturated mono- and/or dicarboxylic acid or a salt thereof, as described as component (b2) below, is used for the polymerization. It is thus ensured that the copolymers used according to the invention have anionogenic/anionic groups. Alternatively, the conditions for the hydrolysis can also be chosen so that some of the ester groups are hydrolyzed with formation of acid groups in the copolymer.

The abovementioned monomers (b1) can be used individually or in the form of any desired mixtures.

Suitable monomers of group (b2) are, for example, monoethylenically unsaturated carboxylic acids having 3 to 8 carbon atoms and the water-soluble salts, such as alkali metal, alkaline earth metal or ammonium salts, of these carboxylic acids and the monoethylenically unsaturated carboxylic anhydrides. This group of monomers includes, for example, acrylic acid, methacrylic acid, dimethacrylic acid, ethacrylic acid, α-chloroacrylic acid, maleic acid, maleic anhydride, fumaric acid, itaconic acid, mesaconic acid, citraconic acid, glutaconic acid, aconitic acid, methylenemalonic acid, allylacetic acid, vinylacetic acid and crotonic acid. The monomers of this group (b2) can be used alone or in a mixture with one another, in partly or in completely neutralized form, in the copolymerization. Bases suitable for the neutralization are mentioned in the case of component (b1).

The water-soluble amphoteric copolymer comprises, incorporated in the form of polymerized units, at least one monomer from the group (b), which monomer is selected from the subgroups (b1) and (b2). Of course, the water-soluble amphoteric copolymer may also comprise mixtures of monomer units from the subgroups (b1) and (b2).

For modification, the copolymers can, if appropriate, comprise at least one further monomer of group (c) incorporated in the form of polymerized units. These monomers are preferably nitriles of α,β-ethylenically unsaturated mono- and dicarboxylic acids, such as, for example, acrylonitrile and methacrylonitrile. In the case of the hydrolysis of such copolymers, amidines having a 5-membered ring are then obtained.

Monomers of group (c) which are furthermore suitable are: esters of α,β-ethylenically unsaturated mono- and dicarboxylic acids with monohydric $C_1$-$C_{30}$-alkanols, $C_2$-$C_{30}$-alkanediols and $C_2$-$C_{30}$-aminoalcohols, amides of α,β-ethylenically unsaturated monocarboxylic acids and the N-alkyl and N,N-dialkyl derivatives thereof, esters of vinyl alcohol and allyl alcohol with $C_1$-$C_{30}$-monocarboxylic acids, N-vinyllactams, nitrogen-containing heterocycles and lactones having α,β-ethylenically unsaturated double bonds, vinylaromatics, vinyl halides, vinylidene halides, $C_2$-$C_8$-monoolefins and mixtures thereof.

Examples of representatives of this group (c) are, for example, methyl (meth)acrylate (the formulation ". . . (meth) acrylate" means in each case ". . . methacrylate" as well as ". . . acrylate"), methyl ethacrylate, ethyl (meth)acrylate, ethyl ethacrylate, n-butyl (meth)acrylate, isobutyl (meth) acrylate, tert-butyl (meth)acrylate, tert-butyl ethacrylate, n-octyl (meth)acrylate, 1,1,3,3-tetramethylbutyl (meth)acrylate, ethylhexyl (meth)acrylate and mixtures thereof.

Suitable additional monomers (c) are furthermore the esters of α,β-ethylenically unsaturated mono- and dicarboxylic acids with aminoalcohols, preferably $C_2$-$C_{12}$-aminoalcohols. These may be $C_1$-$C_8$-monoalkylated or $C_1$-$C_8$-dialkylated on the amine nitrogen. For example, acrylic acid, methacrylic acid, fumaric acid, maleic acid, itaconic acid, crotonic acid, maleic anhydride, monobutyl maleate and mixtures thereof are suitable as the acid component of these esters. Acrylic acid, methacrylic acid and mixtures thereof are preferably used. These include, for example, N-methylamino-methyl (meth)acrylate, N-methylaminoethyl (meth) acrylate, N,N-dimethylaminomethyl (meth)acrylate, N,N-dimethylaminoethyl (meth)acrylate, N,N-diethylaminoethyl (meth)acrylate, N,N-dimethylaminopropyl (meth)acrylate, N,N-diethylaminopropyl (meth)acrylate and N,N-dimethylaminocyclohexyl (meth)acrylate.

Suitable additional monomers (c) are furthermore acrylamide, methacrylamide, N-methyl(meth)acrylamide (the formulation ". . . (meth)acrylamide" represents in each case ". . . acrylamide" and ". . . methacrylamide"), N-ethyl (meth)acrylamide, n-propyl(meth)acrylamide, N-(n-butyl) (meth)acrylamide, tert-butyl(meth)acrylamide, n-octyl (meth)acrylamide, 1,1,3,3-tetramethylbutyl(meth) acrylamide, ethylhexyl(meth)acrylamide and mixtures thereof.

Furthermore, 2-hydroxyethyl (meth)acrylate, 2-hydroxyethyl ethacrylate, 2-hydroxypropyl (meth)acrylate, 3-hydroxypropyl (meth)acrylate, 3-hydroxybutyl (meth)acrylate, 4-hydroxybutyl (meth)acrylate, 6-hydroxyhexyl (meth)acrylate and mixtures thereof are suitable as monomers (c).

In addition, N-[2-(dimethylamino)ethyl]acrylamide, N-[2-(dimethylamino)ethyl]methacrylamide, N[3-(dimethylamino)propyl]acrylamide, N-[3-(dimethylamino)propyl] methacrylamide, N-[4-(dimethylamino)butyl]acrylamide, N-[4-(dimethylamino)butyl]methacrylamide, N-[2-(diethylamino)ethyl]acrylamide, N-[2-(diethylamino)ethyl]methacrylamide and mixtures thereof are suitable as further monomers (c).

Suitable monomers (c) are furthermore N-vinyllactams and derivatives thereof which may have, for example one or more $C_1$-$C_6$-alkyl substituents (as defined above). These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

N-Vinylimidazoles and alkylvinylimidazoles are furthermore suitable as monomers (c), in particular methylvinylimidazoles, such as, for example, 1-vinyl-2-methylimidazole, 3-vinylimidazole N-oxide, 2- and 4-vinylpyridine N-oxides and betaine derivatives and quaternization products of these monomers.

Suitable additional monomers are furthermore ethylene, propylene, isobutylene, butadiene, styrene, α-methylstyrene, vinyl acetate, vinyl propionate, vinyl chloride, vinylidene chloride, vinyl fluoride, vinylidene fluoride and mixtures thereof.

The abovementioned monomers (c) may be used individually or in the form of any desired mixtures.

A further modification of the copolymers is possible by using in the copolymerization monomers (d) which comprise at least two double bonds in the molecule, e.g. triallylamine, methylenebisacrylamide, glycol diacrylate, glycol dimethacrylate, glyceryl triacrylate, pentaerythrityl triallyl ether, polyalkylene glycols or polyols, such as pentaerythritol, sorbitol or glucose, which are at least diesterified with acrylic acid and/or with methacrylic acid. Also suitable are allyl and vinyl ethers of polyalkylene glycols or polyols, such as pentaerythritol, sorbitol or glucose. If at least one monomer of group (d) is used in the copolymerization, the amounts used are up to 2 mol %, e.g. from 0.001 to 1 mol %.

In a preferred embodiment, a monomer mixture is used for the polymerization, the component (b) consisting either only of monomers (b1) or only of monomers of subgroup (b2), with the proviso that the monomer mixture comprises at least one monomer (b) having at least one free acid group and/or one acid group in salt form.

In a particularly preferred embodiment, only monomers of subgroup (b2) are used for the polymerization with the monomers (a).

Typical compositions used according to the invention as agents for increasing the initial wet web strength of the paper are, for example, copolymers which are obtainable by copolymerization of a) from 1 to 99% by weight, preferably from 5 to 95% by weight, in particular from 20 to 90% by weight, based on the total weight of the monomers used for the polymerization, of at least one N-vinylcarboxamide of the general formula (I)

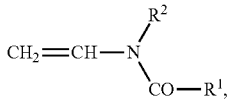

in which $R^1$ and $R^2$, independently of one another, are H or $C_1$- to $C_6$-alkyl, b) from 1 to 99% by weight, preferably from 5 to 95% by weight, in particular from 10 to 80% by weight, based on the total weight of the monomers used for the polymerization, of at least one monomer which is selected from the group consisting of (b1) monoethylenically unsaturated sulfonic acids, phosphonic acids, phosphoric acid esters and derivatives thereof, and (b2) monoethylenically unsaturated mono- and dicarboxylic acids, the salts thereof and dicarboxylic anhydrides, preferably from 1 to 99% by weight, particularly preferably from 5 to 95% by weight, especially preferably from 10 to 80% by weight, based on the total weight of the monomers used for the polymerization, of at least one monomer which is selected from subgroup (b2), c) from 0 to 90% by weight, preferably from 0.1 to 85% by weight, in particular from 1 to 80% by weight, based on the total weight of the monomers used for the polymerization, of at least one monoethylenically unsaturated monomer differing from the components (a) and (b), and d) from 0 to 5% by weight, preferably from 0.0001 to 3% by weight, based on the total weight of the monomers used for the polymerization, of at least one compound which has at least two ethylenically unsaturated double bonds in the molecule, with the proviso that the monomer mixture comprises at least one monomer (b) having at least one free acid group and/or an acid group in salt form.

For example, preferred water-soluble amphoteric copolymers are those which are obtainable by copolymerization of a) at least one N-vinylcarboxmide of the general formula (I)

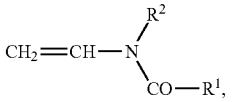

in which $R^1$ and $R^2$, independently of one another, are H or $C_1$- to $C_6$-alkyl, b) at least one monomer from the group (b2), which monomer is selected from monoethylenically unsaturated carboxylic acids having 3 to 8 carbon atoms and the water-soluble salts, such as alkali metal, alkaline earth metal and ammonium salts, of these carboxylic acids, c) if appropriate, at least one monoethylenically unsaturated monomer differing from the components (a) and (b), and d) if appropriate, at least one compound which has at least two ethylenically unsaturated double bonds in the molecule, and subsequent partial or complete hydrolysis of the groups —CO—$R^1$ from the monomers (a) incorporated in the form of polymerized units into the copolymer.

Particularly preferred water-soluble, amphoteric copolymers are those which are obtainable by copolymerization of a) N-vinylformamide, b) acrylic acid, methacrylic acid and/or the alkali metal or ammonium salts thereof, and c) if appropriate, other monoethylenically unsaturated monomers and subsequent elimination of the —CO—R' group from the copolymers.

The hydrolysis of the polymers obtained by the process described above is effected by the action of acids, bases or enzymes, for example hydrochloric acid, sodium hydroxide solution or potassium hydroxide solution, by known methods. Here, copolymers which comprise vinylamine units (VI) and/or amidine units (II-V)

(VI)

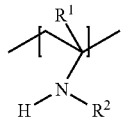

(II)

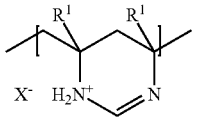

(III)

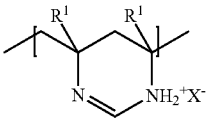

(IV)

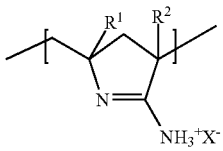

-continued (V)

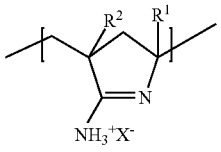

in the amidine units (II) to (V), $X^-$ being in each case an anion and the substituents $R^1$ and $R^2$ in the formulae II-VI having in each case the meaning stated in formula I, form from the monomers (a) of the abovementioned formula (I) which are incorporated in the form of polymerized units, by elimination of the —CO—$R^1$ group.

The originally anionic copolymer acquires cationic groups through the hydrolysis and thus becomes amphoteric.

The amidine units (II) and (Ill) form by reaction of neighboring vinylamine units of the formula (VI) with vinylformamide units or by reaction of neighboring vinylamine units of the formula (VI) with acrylonitrile or methacrylonitrile groups.

The hydrolysis of the copolymers is disclosed in detail, for example, in EP-B-0 672 212 on page 4, lines 38-58 and on page 5, lines 1-25 and in the examples of EP 528 409. Hydrolyzed copolymers where the hydrolysis was carried out in the presence of bases, preferably in the presence of sodium hydroxide solution, are preferably used. The degree of hydrolysis of the vinylcarboxamide groups incorporated in the form of polymerized units is, for example, from 0.1 to 100 mol %, in general from 1 to 98 mol %, preferably from 10 to 80 mol %.

The hydrolyzed copolymers comprise, for example, (i) from 1 to 98 mol %, preferably from 1 to 75 mol % of vinylcarboxamide units, (ii) from 1 to 98 mol %, preferably from 1 to 55 mol %, of units of monoethylenically unsaturated sulfonic acids, phosphonic acids, phosphoric acid esters, derivatives thereof or units of monoethylenically unsaturated mono- and dicarboxylic acids, the salts thereof and dicarboxylic anhydrides, preferably from 1 to 98 mol %, preferably from 1 to 55 mol %, of units of at least one monoethylenically unsaturated carboxylic acid having 3 to 8 carbon atoms, (iii) from 1 to 98 mol %, preferably from 1 to 55 mol %, of vinylamine units of the formula (VI) and/or amidine units of the formula (II) and/or (III), and (iv) up to 50 mol % of units of other monoethylenically unsaturated compounds.

Particularly preferred agents for increasing the initial wet web strength of paper are those hydrolyzed copolymers which comprise (i) from 5 to 70 mol % of vinylcarboxamide units, (ii) from 3 to 30 mol % of units of monoethylenically unsaturated sulfonic acids, phosphonic acids and salts thereof, and (iii) from 10 to 60 mol % of vinylamine units of the formula VI in salt form and/or amidine units of the formula (II) and/or (III), and hydrolyzed copolymers which comprise (i) from 5 to 70 mol % of vinylcarboxamide units, (ii) from 5 to 45 mol % of units of acrylic acid, methacrylic acid, salts and mixtures thereof, and (iii) from 10 to 60 mol % of vinylamine units of the formula VI in salt form and/or amidine units of the formula (II) and/or (III).

Of particular technical importance are those amphoteric copolymers which comprise N-vinylformamide incorporated in the form of polymerized units as component (i).

The ratio B of cationic to anionic groups in the hydrolyzed copolymer is preferably from 12:1 to 1:12, in particular from 7:1 to 1:7.

The preparation of the water-soluble amphoteric copolymers is effected by customary processes known to the person skilled in the art. Suitable processes are described, for example, in EP-A-0 251 182, WO-A-94/13882 and EP-B-0 672 212, which are hereby incorporated by reference. Furthermore, reference is made to the preparation of the water-soluble amphoteric copolymers described in WO-A-04/087818 and WO-A-05/012637.

The preparation of the water-soluble amphoteric copolymers can be effected by solution, precipitation, suspension or emulsion polymerization. Solution polymerization in aqueous media is preferred. Suitable aqueous media are water and mixtures of water and at least one water-miscible solvent, e.g., an alcohol, such as methanol, ethanol, n-propanol, isopropanol, etc.

The polymerization temperatures are preferably in a range from about 30 to 200° C., particularly preferably from 40 to 110° C. The polymerization is usually effected under atmospheric pressure but it can also take place under reduced or superatmospheric pressure. A suitable pressure range is from 0.1 to 5 bar.

The monomers (b) containing acid groups are preferably used in salt form. The pH is preferably adjusted to a value in the range from 6 to 9 for the copolymerization. By use of a customary buffer or by measurement of the pH and corresponding addition of acid or base, the pH can be kept constant during the polymerization.

For the preparation of the polymers, the monomers can be polymerized with the aid of free radical initiators.

Initiators which may be used for the free radical polymerization are the peroxo and/or azo compounds customary for this purpose, for example alkali metal or ammonium peroxodisulfates, diacetyl peroxide, dibenzoyl peroxide, succinyl peroxide, di-tert-butyl peroxide, tert-butyl perbenzoate, tert-butyl perpivalate, tert-butyl peroxy-2-ethyl-hexanoate, tert-butyl permaleate, cumyl hydroperoxide, diisopropyl peroxodicarbamate, bis(o-toluoyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, azobisisobutyronitrile, azobis(2-amidonopropane) dihydrochloride or 2-2'-azobis(2-methylbutyronitrile). Initiator mixtures or redox initiator systems, such as, for example, ascorbic acid/iron(II) sulfate/sodium peroxodisulfate, tert-butyl hydroperoxide/sodium disulfite, tert-butyl hydroperoxide/sodium hydroxymethanesulfinate, $H_2O_2$/CuI, are also suitable.

For establishing the molecular weight, the polymerization can be effected in the presence of at least one regulator. Regulators which may be used are the customary compounds known to the person skilled in the art, such as, for example, sulfur compounds, e.g. mercaptoethanol, 2-ethylhexyl thioglycolate, thioglycolic acid, sodium hypophosphite, formic acid or dodecyl mercaptan, and tribromochloromethane or other compounds which have a regulating effect on the molecular weight of the polymers obtained.

The molar mass of the water-soluble amphoteric copolymers is, for example, at least 10 000, preferably at least 100 000, Dalton and in particular at least 500 000 Dalton. The molar masses of the copolymers are then, for example, from 10 000 to 10 million, preferably from 100 000 to 5 million (for example, determined by light scattering). This molar mass range corresponds, for example, to K values of from 5 to 300, preferably from 10 to 250 (as determined according to H. Fikentscher in 5% strength aqueous sodium chloride solution at 25° C. and a polymer concentration of 0.1% by weight).

The water-soluble, amphoteric copolymers may carry an excess anionic or an excess cationic charge or may be electrically neutral if equal amounts of anionic and cationic groups are present in the copolymer.

The water-soluble, amphoteric copolymers are used for the pretreatment of natural and reclaimed fibers. All fibers usually used in the paper industry and obtained from softwoods and hardwoods, e.g. mechanical pulp, bleached and unbleached chemical pulp and paper stocks obtained from all annual plants, can be used. Mechanical pulp includes, for example, groundwood, thermomechanical pulp (TMP), chemothermo-mechanical pulp (CTMP), pressure groundwood, semichemical pulp, high-yield pulp and refiner mechanical pulp (RMP). For example, sulfate, sulfite and soda pulps are suitable as chemical pulp. Unbleached chemical pulp, which is also referred to as unbleached kraft pulp, is preferably used. Suitable annual plants for the production of paper stocks, are, for example, rice, wheat, sugarcane and kenaf. Wastepaper, which is used either alone or as a mixture with other fibers, can be used for the production of the pulps. The wastepaper may originate, for example, from a de-inking process. However, it is not necessary for the wastepaper to be used to be subjected to such a process. Furthermore, it is also possible to start from fiber mixtures obtained from a primary stock and reclaimed coated waste.

The treatment of the cellulose fibers is carried out in aqueous suspension, preferably in the absence of other process chemicals which are usually used in papermaking. It is preferably effected in the papermaking process by adding at least one water-soluble, amphoteric copolymer comprising amidine groups to an aqueous suspension of fibers. A process variant in which a water-soluble, amphoteric copolymer comprising amidine groups is added to the fiber suspension at a time before further customary process chemicals for papermaking are metered is particularly preferred. In the papermaking process, the water-soluble, amphoteric copolymers can be added, for example, in an amount of from 0.01 to 1.00% by weight, based on dry fiber, to a high-consistency stock and/or a low-consistency stock. Preferably, the water-soluble, amphoteric polymers are metered into a low-consistency stock. In a further preferred variant, the water-soluble, amphoteric copolymers are added to a high-consistency stock and/or a low-consistency stock before a filler is added to the paper stock.

Typical amounts used are, for example, from 0.1 to 10 kg, preferably from 0.3 to 4 kg, of at least one water-soluble, amphoteric copolymer per tonne of a dry fiber. In most cases, the amounts of amphoteric copolymer used are from 0.5 to 2.5 kg of polymer (solid) per tonne of dry fiber.

The time of action of the amphoteric polymers comprising amidine groups on a pure fiber or total stock after the metering up to sheet formation is, for example, from 0.5 seconds to 2 hours, preferably from 1.0 second to 15 minutes, particularly preferably from 2 to 20 seconds.

In a preferred development of the invention, the use of the water-soluble, amphoteric copolymers described above is effected by a pretreatment of an aqueous fiber suspension in a papermaking process before other customary process chemicals are metered into the paper stock.

In the process according to the invention, the process chemicals usually used in papermaking are used in the customary amounts, e.g. retention aids, drainage aids, other dry strength agents, such as, for example, starch, pigments, fillers, optical brighteners, antifoams, biocides and paper dyes. These substances are preferably added to the paper stock only after the treatment according to the invention of the fiber.

The K values of the copolymers were determined according to H. Fikentscher, Cellulose-Chemie, volume 13, 48-64 and 71-74 (1932) in 5.0% strength aqueous sodium chloride solution at 25° C., a pH of 7 and a polymer concentration of 0.1% by weight.

The degree of hydrolysis of the polymer can be determined by enzymatic analysis of the formic acid/formates liberated during the hydrolysis.

The structural composition of the polymers was calculated from the monomer mixture used, the degree of hydrolysis and the vinylamine/amidine ratio determined by means of 13C NMR spectroscopy.

The stated percentages in the examples are percentages by weight, unless stated otherwise.

EXAMPLES

Preparation of the Copolymers

Polymer I

For the preparation of feed 1, 150 g of ice were initially taken in a beaker and first 69.2 g of acrylic acid and then, with stirring, 384 g of a 10% strength sodium hydroxide solution were added. After the end of the neutralization, the solution had a pH of 6.2. 103.4 g of N-vinylformamide were then mixed in.

As feed 2, 0.52 g of 2,2'-azobis(2-methylpropionamidine) dihydrochloride was dissolved in 51 g of water at room temperature.

As feed 3, 0.34 g of 2,2'-azobis(2-methylpropionamidine) dihydrochloride was dissolved in 34.1 g of water at room temperature.

400.0 g of distilled water and 2.1 g of 75% strength phosphoric acid were initially taken in a 2 l glass apparatus having an anchor stirrer, reflux condenser, internal thermometer and nitrogen inlet tube. At a speed of 100 rpm, 8.0 g of a 10% strength sodium hydroxide solution were added so that a pH of 6.5 was reached. 10 l/h of nitrogen were passed into the initially taken mixture for half an hour in order to remove the oxygen present. The initially taken mixture was heated to 74° C. Feeds 1 and 2 were then started simultaneously. At a constant 74° C., feed 1 was run in in 2 hours and feed 2 in 3 hours. After the end of the addition of feed 2, the reaction mixture was postpolymerized for a further hour at 74° C. Feed 3 was then added all at once and the mixture was then subjected to a postpolymerization for a further 2 h at 74° C. Finally, 403 g of water were added and the batch was cooled to room temperature. A slightly yellow, viscous solution having a solids content of 12.4% was obtained. The K value of the terpolymer was 115.

528.0 g of the above product were heated to 80° C. in a 1 l three-necked flask having a blade stirrer, internal thermometer, dropping funnel and reflux condenser at a stirrer speed of 80 rpm. After this temperature had been reached, first 2.4 g of a 25% strength aqueous sodium disulfite solution and then 40.4 g of a 25% strength aqueous sodium hydroxide solution were added so that they mixed in thoroughly. The reaction mixture was kept at 80° C. for 3 hours and then cooled to room temperature. By slow addition of about 17.7 g of concentrated hydrochloric acid, the pH was adjusted to 8.6. A viscous, colorless, slightly turbid solution having a solids content of 13.6% was obtained. The degree of hydrolysis of the incorporated vinylformamide units was 50 mol %.

The polymer I obtained had the following structural units:
vinylformamide: 30 mol %
vinylamine: 16 mol %
amidine: 14 mol %
sodium acrylate: 40 mol %

Polymer II

For the preparation of feed 1, 44.9 g of water and 105 g of ice were initially taken in a beaker. 49.8 g of acrylic acid and, with stirring, 264.6 g of a 10% strength aqueous sodium hydroxide solution were then added. After the end of the neutralization, the solution had a pH of 6.5. 115.8 g of N-vinylformamide were then mixed in.

As feed 2, 0.63 g of 2,2'-azobis(2-methylpropionamidine) dihydrochloride was dissolved in 50 g of water at room temperature.

As feed 3, 0.16 g of 2,2'-azobis(2-methylpropionamidine) dihydrochloride was dissolved in 8.8 g of water at room temperature.

480.0 g of distilled water and 1.3 g of 75% strength phosphoric acid were initially taken in a 2 l glass apparatus having an anchor stirrer, reflux condenser, internal thermometer and nitrogen inlet tube. At a speed of 100 rpm, 4.9 g of a 10% strength aqueous sodium hydroxide solution were added so that a pH of 6.6 was reached. 10 l/h of nitrogen were passed into the initially taken mixture for half an hour in order to remove the oxygen present. The initially taken mixture was heated to 73° C. Feeds 1 and 2 were then started simultaneously. At a constant 73° C., feed 1 was run in in 2 hours and feed 2 in 3 hours. After the end of the addition of feed 2, the reaction mixture was postpolymerized for a further hour at 73° C. Feed 3 was then added all at once and the reaction mixture was then subjected to a postpolymerization for a further 2 h at 73° C. Finally, 373 g of water were added and the batch was cooled to room temperature. A virtually colorless, viscous solution having a solids content of 12.7% was obtained. The K value of the polymer was 119.

576.0 g of the above product were heated to 80° C. in a 1 l three-necked flask having a blade stirrer, internal thermometer, dropping funnel and reflux condenser at a stirrer speed of 80 rpm. First 3.3 g of a 25% strength aqueous sodium disulfite solution and then 32.4 g of a 25% strength aqueous sodium hydroxide solution were added so that they mixed in thoroughly. The reaction mixture was kept at 80° C. for 3 hours and then cooled to room temperature. By slow addition of about 13.6 g of concentrated hydrochloric acid, the pH was adjusted to 9.0. A viscous, pale yellowish, slightly turbid solution having a solids content of 10.9% was obtained. The degree of hydrolysis was 32 mol %, based on the N-vinylformamide incorporated in the form of polymerized units.

The polymer II obtained comprised the following structural units:
vinylformamide: 48 mol %
vinylamine: 9 mol %
amidine: 13 mol %
sodium acrylate: 30 mol %

Polymer III

This polymer was prepared according to the information in example 1 of JP-A-08059740. The polymer III thus obtained had a K value of 65 and comprised the following structural units:
vinylformamide: 20 mol %
vinylamine: 10 mol %
amidine: 35 mol %
sodium acrylate: 05 mol %
acrylonitrile: 30 mol %

Polymer IV (prepared according to WO-A-05/012637, example 1)

1339.0 g of distilled water, 3.8 g of 75% strength phosphoric acid, 202.0 g of 25% strength sodium vinylsulfonate solution in water and 69.9 g of acrylic acid were mixed at a speed of 100 rpm in a 2 l glass apparatus having an anchor stirrer, reflux condenser, internal thermometer and nitrogen inlet tube. The pH was adjusted to 6.8 by dropwise addition of about 84 g of a 50% strength aqueous sodium hydroxide solution. 181.4 g of vinylformamide were then added. The mixture was heated to 62° C. while passing in nitrogen. After this temperature had been reached, 20.0 g of a 1.5% strength aqueous solution of 2,2'-azobis(2-methylpropionamidine) dihydrochloride were added in the course of 5 min. A further 81.5 g of a 1.5% strength aqueous solution of 2,2'-azobis(2-methylpropionamidine) dihydrochloride were run in in the course of 4 hours. After a polymerization time of 3 hours, the temperature was increased to 75° C. After a further hour at 75° C., 0.75 g of 2,2'-azobis(2-methylpropionamidine) dihydrochloride in 20.0 g of distilled water was added and postpolymerization was effected for 2 hours at 75° C. After cooling to room temperature, a slightly turbid, colorless, highly viscous solution having a solids content of 18.6% was obtained. The K value of the terpolymer was 122.

500.0 g of the above product were heated to 80° C. in a 1 l three-necked flask having a blade stirrer, internal thermometer, dropping funnel and reflux condenser at a stirrer speed of 80 rpm. First 6.3 g of a 25% strength aqueous sodium disulfite solution and then 60.5 g of a 25% strength aqueous sodium hydroxide solution were metered in in such a way that the added components mixed in thoroughly. The reaction mixture was kept at 80° C. for 3 hours and then cooled to room temperature. By slow addition of about 31 g of concentrated hydrochloric acid, the pH was adjusted to 7.2. 234.0 g of distilled water were then added for dilution of the reaction mixture. After cooling to room temperature, a viscous, colorless, slightly turbid solution having a solids content of 15.0% was obtained. The degree of hydrolysis of the incorporated vinylformamide units was 59 mol %.

The polymer IV obtained comprised the following structural units:
vinylformamide: 18 mol %
vinylamine: 21 mol %
amidine: 22 mol %
sodium vinylsulfonate: 11 mol %
sodium acrylate: 28 mol %

Testing of the polymers I to IV described above as agents for increasing the initial wet web strength of paper Examples 1 to 4

A mixture of bleached birch sulfate and bleached pine sulfite was beaten speck-free in a laboratory pulper in the ratio of 70/30 at a solids concentration of 4% until the freeness of 30° SR was reached. An optical brightener (Blankophor® PSG) and a digested cationic starch (HiCat® 5163 A) were then added to the beaten stock. The digestion of the cationic starch was effected as a 10% strength starch slurry in a jet digester at 130° C. and with a residence time of 1 minute. The amount of optical brightener metered was 0.5% of commercial product, based on the solids content of the paper stock suspension. The amount of cationic starch metered was 0.5% of starch, based on the solids content of the paper stock suspension. The solids concentration of the fiber suspension after addition of starch and optical brightener was 3.7%.

Four beakers were filled in each case with 50 g of the fiber suspension described above and then diluted to a solids concentration of in each case 0.35% by addition of water. In each case one of the polymers I to IV described above was metered as a 1% strength aqueous solution in each of these samples with gentle stirring of the fiber suspension. The added amount was 0.3 g. Thereafter, a filler in the form of a commercially available carbonate pigment (GCC, Hydrocarb® 60, from Omya) was added. The pigment slurry was diluted to a solids content of 20% before the addition to the fiber. The added amount of filler slurry was adjusted in a plurality of preliminary experiments so that the filler content in the laboratory sheets formed thereafter was about 20%.

Examples 5 to 8

A mixture of bleached birch sulfate and bleached pine sulfite was beaten speck-free in a laboratory pulper in the ratio of 70/30 at a solids concentration of 4% until the freeness of 30° SR was reached. An optical brightener (Blankophor® PSG) and a digested cationic starch (HiCat® 5163 A) were then added to the beaten stock. The digestion of the cationic starch was effected as a 10% strength starch slurry in a jet digester at 130° C. and with a residence time of 1 minute. The amount of optical brightener metered was 0.5% of commercial product, based on the solids content of the paper stock suspension. The amount of digested cationic starch metered was 0.5% of starch, based on the solids content of the paper stock suspension. The solids concentration of the fiber suspension after addition of starch and optical brightener was 3.7%.

Four beakers were filled with in each case 50 g of the fiber suspension described above. In each case one of the polymers I to IV described above was added as a 1% strength aqueous solution to each of the samples with gentle stirring of the fiber suspension. The added amount was 0.3 g. The stock treated with the polymer was then diluted in each case to a solids concentration of 0.35% by the addition of water. A filler in the form of a commercially available carbonate pigment (GCC, Hydrocarb 60, from Omya) was then metered. The pigment slurry was diluted to a solids content of 20% before the addition to the fiber. The added amount of filler slurry was adjusted in a plurality of preliminary experiments so that the filler content in the laboratory sheets formed thereafter was about 20%.

Examples 9 to 12

A mixture of bleached birch sulfate and bleached pine sulfite was beaten speck-free in a laboratory pulper in the ratio of 70/30 at a solids concentration of 4% until the freeness of 30° SR was reached. An optical brightener (Blankophor® PSG) and a digested cationic starch (HiCat® 5163 A) were then added to the beaten stock. The digestion of the cationic starch was effected as a 10% strength aqueous starch slurry in a jet digester at 130° C. and with a residence time of 1 minute. The amount of optical brightener metered was 0.5% of commercial product, based on the solids content of the paper stock suspension. The amount of cationic starch metered was 0.5% of starch, based on the solids content of the paper stock suspension. The solids concentration of the fiber suspension after addition of starch and optical brightener was 3.7%.

Four beakers were filled in each case with 50 g of the fiber suspension described above. These suspensions were then diluted to a solids concentration of in each case 0.35% by addition of water. A filler in the form of a commercially available carbonate pigment (GCC, Hydrocarb 60, from Omya) was then added. The aqueous pigment slurry was diluted to a solids content of 20% before the addition to the fiber. The added amount of filler slurry was adjusted in a plurality of preliminary experiments so that the filler content of the laboratory sheets subsequently to be formed was about 20%. After the addition of the filler slurry, in each case the polymers I to IV were added as a 1% strength solution and with gentle stirring to the fiber suspension. The added amount was 0.3 g in each case.

Comparative Example 1

A mixture of bleached birch sulfate and bleached pine sulfite was beaten speck-free in a laboratory pulper in the ratio of 70/30 at a solids concentration of 4% until the freeness of 30° SR was reached. An optical brightener (Blankophor® PSG) and a digested cationic starch (HiCat® 5163 A) were then added to the beaten stock. The digestion of the cationic starch was effected as a 10% strength aqueous starch slurry in a jet digester at 130° C. and with a residence time of 1 minute. The amount of optical brightener metered was 0.5% of commercial product, based on the solids content of the paper stock suspension. The amount of cationic starch metered was 0.5% of starch, based on the solids content of the paper stock suspension. The solids concentration of the fiber suspension after addition of starch and optical brightener was 3.7%.

50 g of the fiber suspension thus prepared were introduced into a beaker. The stock was diluted to a solids concentration of 0.35% by addition of water. A filler in the form of a commercially available carbonate pigment (GCC, Hydrocarb 60, from Omya) was then added. Before the addition to the fiber, the aqueous pigment slurry was diluted to a solids content of 20% by addition of water. The added amount of filler slurry was adjusted in a plurality of preliminary experiments so that the filler content of the laboratory sheets subsequently to be formed was about 20%.

Production of laboratory sheets and determination of the initial wet web strength The suspensions described in examples 1 to 12 and in comparative example 1 were processed in each case two minutes after the last addition step on a Rapid-Kothen sheet former according to ISO 5269/2 to give sheets having a basis weight of 100 g/m$^2$.

The determination of the initial wet web strength on the wet paper was effected in each case by the Voith method (cf. M. Schwarz and K. Bechtel "Initiale Gefügefestigkeit bei der Blattbildung", in Wochenblatt für Papierfabrikation 131, pages 950-957 (2003) No. 16. For this purpose, the wet sheets were knocked off the wire frame of the Rapid-Köthen sheet former onto a plastic substrate and transferred to the cutting substrate.

Test strips having a defined length and width were then cut from the sheet. These were pressed under constant pressure until the desired solids content was reached. For the investigations of the paper sheets obtained according to the examples stated above, in each case four solids contents in the range from 42% to 58% were established. The initial wet web strength at 50% solids content was determined with the aid of a mathematical method of fit described in the abovementioned literature reference. The actual measurement of the initial wet web strength was effected on a vertical tensile tester with a special clamping device. The force determined in the tensile tester was converted into the basis weight-independent so-called INF index. For an exact description of the clamping device, of the measuring procedure, of the determination of the solids content of the paper and of the data processing, see the abovementioned literature reference.

The results of the tests are reproduced in table 1.

TABLE 1

| | INF index [Nm/g] |
|---|---|
| Example 1 | 3.0 |
| Example 2 | 2.9 |
| Example 3 | 2.9 |
| Example 4 | 3.4 |
| Example 5 | 2.2 |
| Example 6 | 2.2 |
| Example 7 | 2.1 |
| Example 8 | 2.4 |
| Example 9 | 2.3 |
| Example 10 | 2.4 |
| Example 11 | 2.5 |
| Example 12 | 2.6 |
| Comparative example 1 | 1.8 |

We claim:

1. A process for producing paper, comprising adding 0.01 to 1.00% by weight, based on dry fiber, of water-soluble, amphoteric copolymers to a high-consistency fiber stock, and adding a filler to the high-consistency fiber stock, wherein the water-soluble, amphoteric copolymers are obtained by a polymerization process comprising:

(1) copolymerization of a mixture comprising a) at least one N-vinylcarboxamide of the general formula (I)

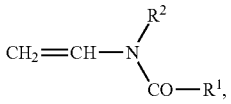

in which $R^1$ and $R^2$, independently of one another, are H or $C_1$- to $C_6$-alkyl, b) at least one monomer which is selected from the group consisting of (b1) monoethylenically unsaturated sulfonic acids, phosphonic acids, phosphoric acid esters and derivatives thereof, and (b2) monoethylenically unsaturated mono- and dicarboxylic acids, the salts thereof and dicarboxylic anhydrides, c) optionally, at least one monoethylenically unsaturated monomer differing from the components (a) and (b), and d) optionally, at least one compound which has at least two ethylenically unsaturated double bonds in the molecule, wherein the monomer mixture comprises at least one monomer (b) having at least one free acid group and/or an acid group in salt form; and (2) subsequent partial or complete hydrolysis of the groups —CO—$R^1$ from the monomers (a) incorporated in the form of copolymerized units into the copolymer.

2. The process according to claim 1, wherein the copolymer is obtained by a polymerization process comprising copolymerizing a) from 1 to 99% by weight, based on the total weight of the monomers used for the polymerization, of at least one N-vinylcarboxamide of the general formula (I)

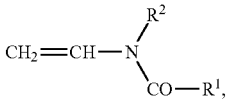

in which $R^1$ and $R^2$, independently of one another, are H or $C_1$- to $C_6$-alkyl, b) from 1 to 99% by weight, based on the total weight of the monomers used for the polymerization, of at least one monomer which is selected from the group consisting of (b1) monoethylenically unsaturated sulfonic acids, phosphonic acids, phosphoric acid esters and derivatives thereof, and (b2) monoethylenically unsaturated mono- and dicarboxylic acids, the salts thereof and dicarboxylic anhydrides, c) from 0 to 90% by weight, based on the total weight of the monomers used for the polymerization, of at least one monoethylenically unsaturated monomer differing from the components (a) and (b), and d) from 0 to 5% by weight, based on the total weight of the monomers used for the polymerization, of at least one compound which has at least two ethylenically unsaturated double bonds in the molecule.

3. The process according to claim 1, wherein the copolymer is obtained by a polymerization process comprising copolymerizing a) from 5 to 95% by weight, based on the total weight of the monomers used for the polymerization, of at least one N-vinylcarboxamide of the general formula (I)

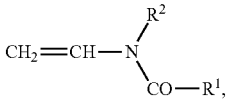

in which $R_1$ and $R_2$, independently of one another, are H or $C_1$- to $C_6$-alkyl, b) from 5 to 95% by weight, based on the total weight of the monomers used for the polymerization, of at least one monomer which is selected from the group consisting of (b1) monoethylenically unsaturated sulfonic acids, phosphonic acids, phosphoric acid esters and derivatives thereof, and (b2) monoethylenically unsaturated mono- and dicarboxylic acids, the salts thereof and dicarboxylic anhydrides, c) from 0.1 to 85% by weight, based on the total weight of the monomers used for the polymerization, of at least one monoethylenically unsaturated monomer differing from the components (a) and (b), and d) from 0 to 3% by weight, based on the total weight of the monomers used for the polymerization, of at least one compound which has at least two ethylenically unsaturated double bonds in the molecule.

4. The process according to claim 1, wherein the copolymer is obtained by a polymerization process comprising: copolymerizing a) N-vinylformamide b) acrylic acid, methacrylic acid and/or the alkali metal or ammonium salts thereof, and c) if appropriate, other monoethylenically unsaturated monomers; and subsequently eliminating the —CO—$R^1$ group from the copolymers with formation of vinylamine units (VI)

(VI)

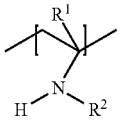

and/or amidine units (II-V)

(II)

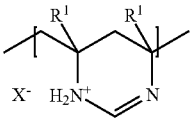

(III)

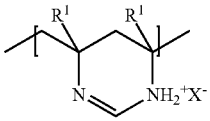

(IV)

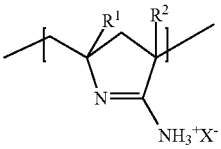

(V)

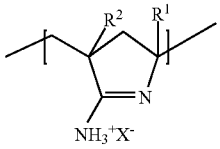

in the amidine units (II) to (V), $X^-$ being in each case an anion and the substituents $R^1$ and $R^2$ in the formulae II-VI having in each case the meaning stated in formula I.

5. The process according to claim 1, wherein the copolymer comprises (i) from 1 to 98 mol % of vinylcarboxamide units, (ii) from 1 to 98 mol % of units of monoethylenically unsaturated sulfonic acids, phosphonic acids, phosphoric acid esters, derivatives thereof or units of monoethylenically unsaturated mono- and dicarboxylic acids, the salts thereof and dicarboxylic anhydrides, (iii) from 1 to 98 mol % of vinylamine units of the formula (VI) and/or amidine units of the formula (II) and/or (III), and (iv) up to 50 mol % of units of other monoethylenically unsaturated compounds incorporated in the form of polymerized units.

6. The process according to claim 1, wherein the copolymer comprises (i) from 5 to 70 mol % of vinylcarboxamide units, (ii) from 3 to 30 mol % of units of monoethylenically unsaturated sulfonic acids, phosphonic acids and salts thereof or from 5 to 45 mol % of units of acrylic acid, methacrylic acid, salts and mixtures thereof, and (iii) from 10 to 60 mol % of vinylamine units of the formula VI in salt form and/or amidine units of the formula (II) and/or (III).

7. The process according to claim 1, wherein the copolymer comprises (i) from 5 to 70 mol % of vinylcarboxamide units, (ii) from 5 to 45 mol % of units of acrylic acid, methacrylic acid, salts and mixtures thereof, and (iii) from 10 to 60 mol % of vinylamine units of the formula VI in salt form and/or amidine units of the formula (II) and/or (III).

8. The process according to claim 1, wherein the water-soluble, amphoteric copolymers are added to a stock comprising a fiber before addition of a filler.

9. The process according to claim 1, wherein said treating comprises adding the water-soluble, amphoteric copolymer to an aqueous suspension of fibers.

10. The process according to claim 8, wherein said treating comprises adding the water-soluble, amphoteric copolymer to stock in an amount of from 0.01 to 1.00% by weight, based on the weight of fiber.

11. The process according to claim 8, wherein the stock is a low-consistency stock.

12. The process according to claim 8, wherein the stock is a high-consistency stock.

13. The process according to claim 1, wherein the high-consistency stock has a fiber concentration larger than 15 g/l.

14. The process according to claim 1, wherein the high-consistency stock has a fiber concentration in a range of from 25 to 60 g/l.

15. The process according to claim 1, wherein the filler comprises a carbonate pigment.

* * * * *